US007363885B2

(12) United States Patent
Miyake et al.

(10) Patent No.: US 7,363,885 B2
(45) Date of Patent: Apr. 29, 2008

(54) COMBUSTION ENGINE HAVING UNITARY STRUCTURE OF COOLING FAN AND STARTER PULLEY

(75) Inventors: Hitomi Miyake, Miki (JP); Shinichi Tanba, Lincoln, NE (US); Ichiro Uemura, Kobe (JP); Tetsuhiro Yamakawa, Maryvill, MO (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 377 days.

(21) Appl. No.: 11/159,867

(22) Filed: Jun. 23, 2005

(65) Prior Publication Data

US 2006/0288970 A1 Dec. 28, 2006

(51) Int. Cl.
*F01P 7/02* (2006.01)

(52) U.S. Cl. ..... 123/41.11; 123/185.3

(58) Field of Classification Search ..... 123/41.11, 123/41.65, 185.3

See application file for complete search history.

(56) References Cited

U.S. PATENT DOCUMENTS 1,789,871 A * 1/1931 Knight ..... 55/317
2,620,782 A * 12/1952 Stegeman ..... 123/41.65
5,065,720 A * 11/1991 Nishiyama et al. ..... 123/363
5,066,196 A * 11/1991 Morofushi ..... 416/241 A
5,230,314 A * 7/1993 Kawahara et al. ..... 123/317
6,006,703 A * 12/1999 Nakamura et al. ..... 123/41.65

FOREIGN PATENT DOCUMENTS

JP 5-24921 2/1993

* cited by examiner

*Primary Examiner*—Stephen K. Cronin
*Assistant Examiner*—Katrina B. Harris

(57) ABSTRACT

A combustion engine according to the present invention has a unitary fan-pulley assembly (F), in which a cooling fan (8) and a starter pulley (9) are formed integrally with each other. The cooling fan (8) is fixed to a crankshaft (1). The pulley (9) receives a starting force when engaged with engagement pawls 14*b* integral with a recoil starter (14). A bracket (11) is fixedly mounted on the crankshaft (1) together with the unitary fan-pulley assembly (F) for urging engagement grooves (92), each defined between neighboring engagement projections (91) of the starter pulley (9), in an axial direction of the unitary fan-pulley assembly (F).

13 Claims, 7 Drawing Sheets

COMBUSTION ENGINE HAVING UNITARY STRUCTURE OF COOLING FAN AND STARTER PULLEY

BACKGROUND OF THE INVENTION

1. Field of the Invention

The present invention generally relates to a combustion engine utilizable as a drive source for a working machine such as a lawn mower and, more particularly, to the combustion engine, in which a cooling fan and a starter pulley are integrated together.

2. Description of the Prior Art

The drive source for a working machine such as a lawn mower is generally used in the form of a combustion engine of a vertical shaft type. This type of combustion engine includes a crankshaft so accommodated within a crankcase as to extend vertically. A lower end of the crankshaft protrudes downwardly and outwardly from the crankcase to serve as a drive output shaft. As an example of the mounting structure for a cooling fan and a starter pulley employed in the combustion engine of this kind, what is shown in FIG. 11 is currently available. See, for example, the Japanese Laid-open Utility Model Publication No. 5-24921 (the abstract on page 1 and the drawings).

Referring to FIG. 11, a vertically extending crankshaft 70 has an upper end 71, on which a flywheel 73 formed integrally with a cooling fan 72 is mounted, and a starter pulley 74 for receiving a starting force from a recoil starter (not shown) is fixed to the flywheel 73 by a set bolt 75. The cooling fan 72 is formed integrally with the flywheel 73 by casting a cast material such as cast iron by the use of a suitable casting such as a centrifugal casting or a die casting, thereby minimizing the number of component parts used.

It has, however, been found that when the flywheel 73 and the cooling fan 72 are formed integrally with each other by casting, it is necessary for blades of the cooling fan 72 to have a thickness as small as possible to increase the performance of the cooling fan 72 and, on the other hand, for the flywheel 73 to have an increased weight to increase the inertia force of rotation. To this end, the cooling fan 72 having the thin and complicated-shape blades will eventually be formed integrally with the bulky flywheel 73, making it difficult to accomplish the casting.

SUMMARY OF THE INVENTION

In view of the foregoing, the present invention is intended to provide a combustion engine having a unitary fan-pulley assembly, in which a cooling fan and a starter pulley are integrated together, which assembly is effective to render a relatively heavy flywheel to be useable and to make it possible to reduce the thickness of rotary blades of the cooling fan.

In order to accomplish the foregoing object of the present invention, there is provided a combustion engine having a unitary fan-pulley assembly, which engine includes a crankshaft, a cooling fan fixedly mounted on the crankshaft, and a starter pulley for receiving a starting force through engagement with engagement pawls of a recoil starter. The cooling fan and the starter pulley are formed integrally with each other to define the unitary fan-pulley assembly.

According to the present invention, it is not a flywheel, but the starter pulley that is formed integrally with the cooling fan. In other words, the flywheel is a member separate from the cooling fan and is made as a unitary component by casting and, therefore, it can provide a relatively large inertia force of rotation. On the other hand, the unitary fan-pulley assembly, in which the cooling fan and the starter pulley are formed integrally with each other, can be formed by the use of, for example, a resin molding and, therefore, as compared with the conventional case in which the cooling fan is integrally formed with the flywheel and a separate pulley is fitted to this flywheel, the number of component parts used will not increase.

Also, in view of characteristics of the resin molding, as rotary blades of the cooling fan can easily be formed thin-walled, the performance of the cooling fan can advantageously be increased. In addition, In the case of the resin molding, the use of one of polyamide resin and glass fiber reinforced resin is effective to impart a sufficient strength to the cooling fan and the starter pulley. Yet, since the unitary fan-pulley assembly is a unitary assembly of the cooling fan and the pulley, not only can the mountability onto the crankshaft be increased, but also removal during the maintenance such as the cleaning of the cooling fan and the servicing of the pulley can easily be accomplished. On the other hand, the flywheel as a unitary component can have an increased weight to provide a large inertia force of rotation.

In a preferred embodiment of the present invention, the pulley has a plurality of engagement projections that are engageable with the engagement pawls of the recoil starter. A bracket may be fixedly mounted on the crankshaft together with the unitary fan-pulley assembly and may be operable to urge a plurality of engagement grooves, each defined between the neighboring engagement projections of the starter pulley, in an axial direction of the unitary fan-pulley assembly.

According to this structural feature, since the engagement grooves each between the neighboring engagement projections are axially urged by the bracket, deformation of the engagement projections, which would otherwise result from engagement between the engagement pawls and the corresponding engagement projections, can advantageously be suppressed. Also, fixing of the bracket on the crankshaft results in simultaneous fixing of the unitary fan-pulley assembly on the crankshaft and, therefore, there is no need to fix the bracket and the unitary fan-pulley assembly separately on the crankshaft, resulting in reduction of the number of manufacturing steps.

In another preferred embodiment of the present invention, a dust screen member may be disposed axially outwardly of the unitary fan-pulley assembly and have an inner peripheral wall that is so defined in an inner periphery thereof as to extend axially and proximately along respective outer surfaces of the engagement projections.

The dust screen member rotates together with the unitary fan-pulley assembly to prevent dust such as lawn grasses from being sucked into the cooling fan together with a current of air during the intake of air. Also, since the inner peripheral wall of the screen member is held proximate to the outer surfaces of the engagement projections of the pulley, it is possible to suppress deformation of the engagement projections in a direction radially outwardly thereof during engagement of them with the engagement pawls.

In a further preferred embodiment of the present invention, the unitary fan-pulley assembly and the bracket may be fastened to the crankshaft by a common fastening member.

According to this structural feature, since the unitary fan-pulley assembly and the brackets can be fixed to the crankshaft simultaneously by a single fastening member, not only can the workability be increased, but the use of an dedicated fastening member for each of the unitary fan-pulley assembly and the bracket is not required, resulting in minimization of the number of fastening members required.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
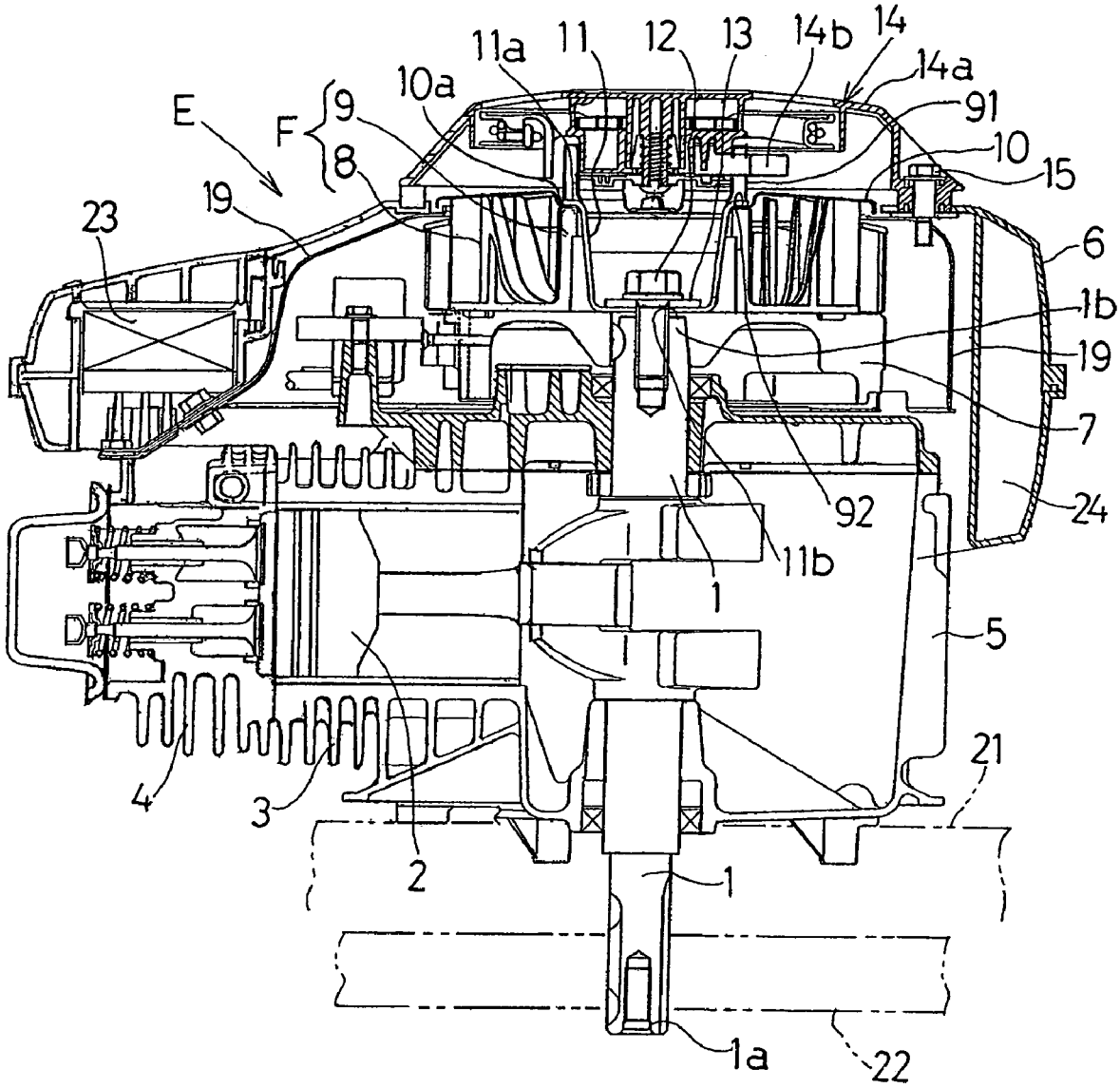
FIG. 1 is a longitudinal sectional view of an internal combustion engine employing an unitary fan-pulley assembly according to a preferred embodiment of the present invention.

For describing a preferred embodiment of the present invention, reference will now be made to the accompanying drawings. In particular, FIG. 1 illustrates a longitudinal sectional view of an internal combustion engine E of a vertical shaft type, in which a cooling fan 8 and a starter pulley 9, both made of a synthetic resin, are integrated together by resin molding to form an unitary fan-pulley assembly F, is employed in accordance with the embodiment of the present invention. As shown therein, the vertical shaft type combustion engine E includes a crankcase 5 accommodating a crankshaft 1. The crankshaft 1 extends vertically through the interior of the crankcase 5. The engine E also includes an engine cylinder block 3 accommodating a horizontally reciprocating piston 2. The piston 2 is drivingly connected with the crankshaft 1 through a connecting rod so that the piston 2 can undergo horizontal reciprocating motion in the cylinder block 3. A cylinder head 4 is secured to the cylinder block 3. The crankshaft 1 has upper and lower ends 1*b* and 1*a* opposite to each other that protrude outwardly upwards and downwards from the crankcase 5, respectively. The lower end 1*a* is utilized as a drive output shaft. Where the combustion engine E is drivingly coupled with a working machine such as a lawn mower 21, a cutter blade assembly 22 is connected to the drive output shaft 1*a* of the crankshaft 1. The cylinder block 3, the cylinder head 4 and the crankcase 5 are covered from above by an engine cover 6 having an air cleaner 23 and a fuel tank 24 built therein.

The unitary fan-pulley assembly F, formed as an integer by integrating the cooling fan 8 and the starter pulley 9, both made of a synthetic resin, by resin molding, and a flywheel 7 are fixedly connected to the upper end 1*b* of the crankshaft 1 and are housed within a fan housing 19. A dust screen member 10 is mounted over an axial outer surface of the unitary fan-pulley assembly F. The fan housing 19 is mounted inside the engine cover 6 for guiding a cooling air induced by the cooling fan 8 towards the cylinder block 3, the cylinder head 4 and the crankcase 5.

Figure 2:
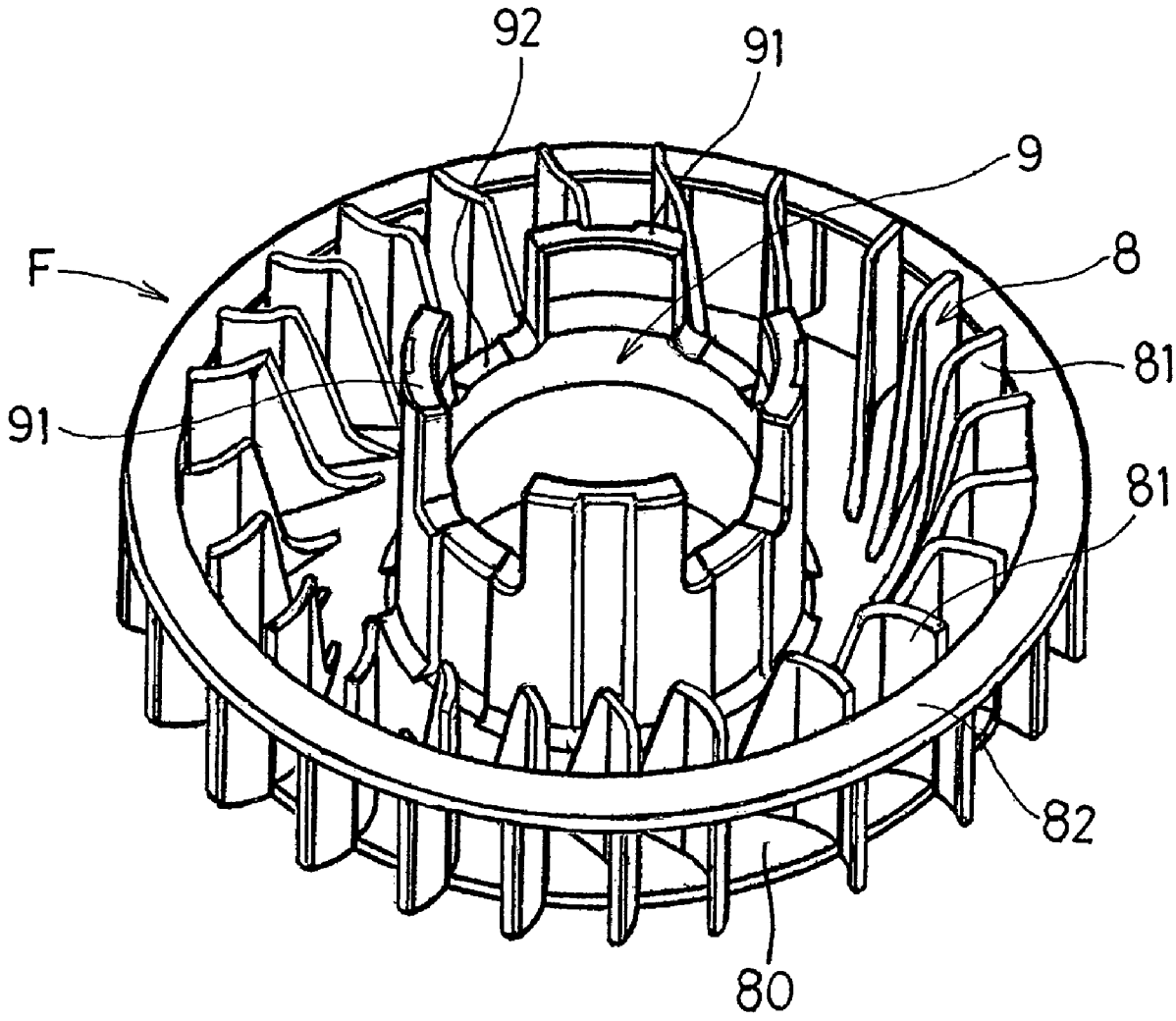
FIG. 2 is a perspective view of the unitary fan-pulley assembly employed in the combustion engine shown in FIG. 1.
Figure 3:
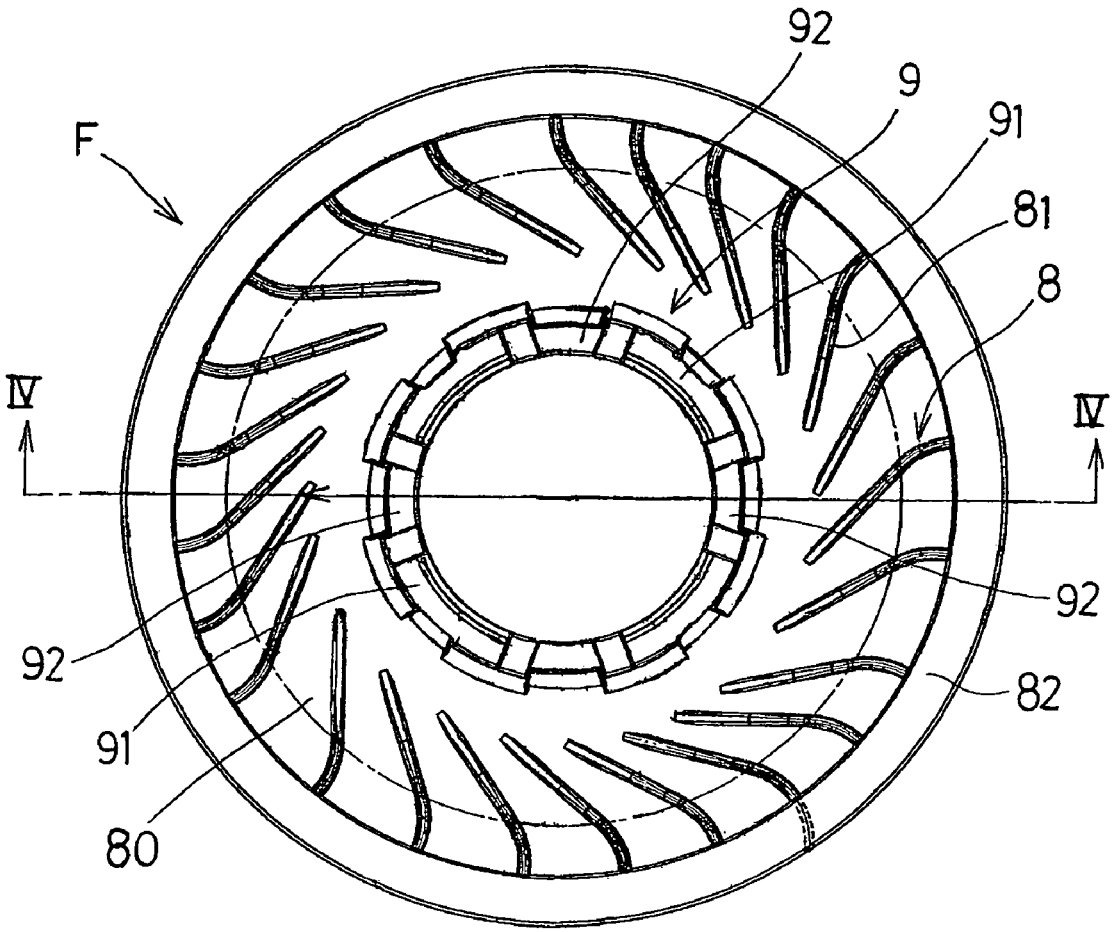
FIG. 3 is a top plan view of the unitary fan-pulley assembly shown in FIG. 2.

As described above, the unitary fan-pulley assembly is formed by integrally molding the cooling fan 8 and the starter pulley 9 by resin molding. As shown in FIG. 2, the cooling fan 8 includes an annular base 80 and a plurality of fan blades 81. The fan blades 81 are arranged around the annular base 80 and spaced an equal distance from each other in a direction circumferentially of the annular base while lying substantially at right angles to the annular base. The starter pulley 9 is positioned at the center of the annular base 80, that is, the center of the unitary fan-pulley assembly F. Those fan blades 81 are circumferentially connected together at their radial outer edges by an annular reinforcement ring 82 to prevent the fan blades 81 from being deformed due to centrifugal force during rotation of the unitary fan-pulley assembly F. The fan blades 81 are, as can readily be understood from FIG. 3, in the form of thin curved plates.

Figure 4:
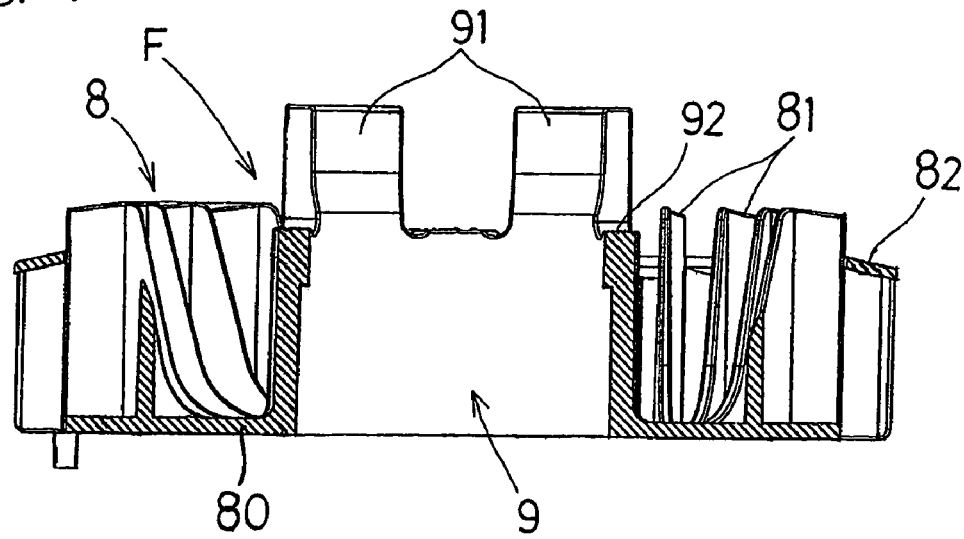
FIG. 4 is a cross sectional view taken along the line IV-IV in FIG. 2.

The starter pulley 9 generally represents a drum-like shape and has a plurality of, for example, four axial engagement projections 91, spaced an equal distance from each other in a direction circumferentially thereof, and engagement grooves 92 each defined between the neighboring engagement projections 91. As shown in FIG. 4, the engagement projections 91 extend axially upwardly.

For the resinous material used to form the unitary fan-pulley assembly F, a high strength resinous material, for example, a polyamide resin or a glass fiber reinforced resin can be suitably employed to provide the cooling fan 8 and the starter pulley 9, that is, the unitary fan-pulley assembly F, with a sufficient strength.

Figure 5:
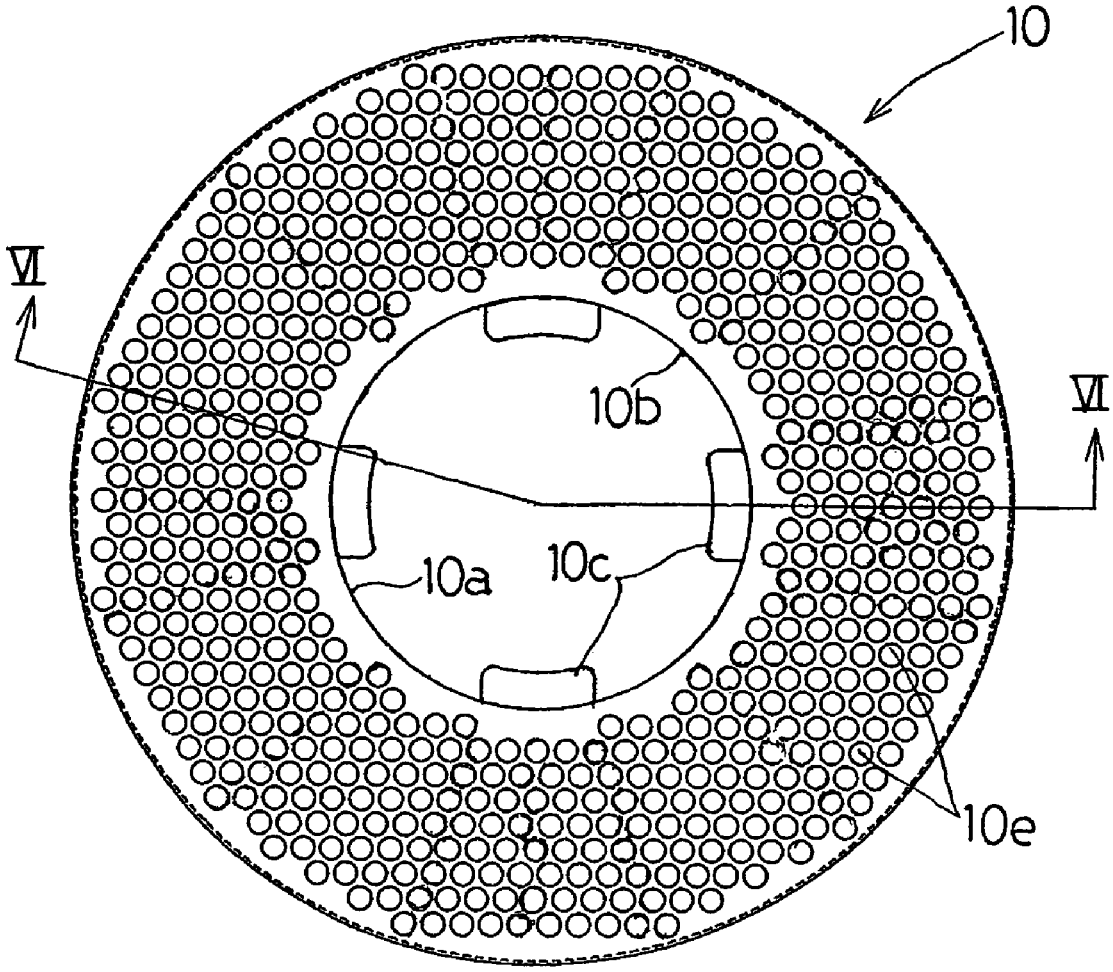
FIG. 5 is a top plan view showing a dust screen member employed in the combustion engine.
Figure 6:
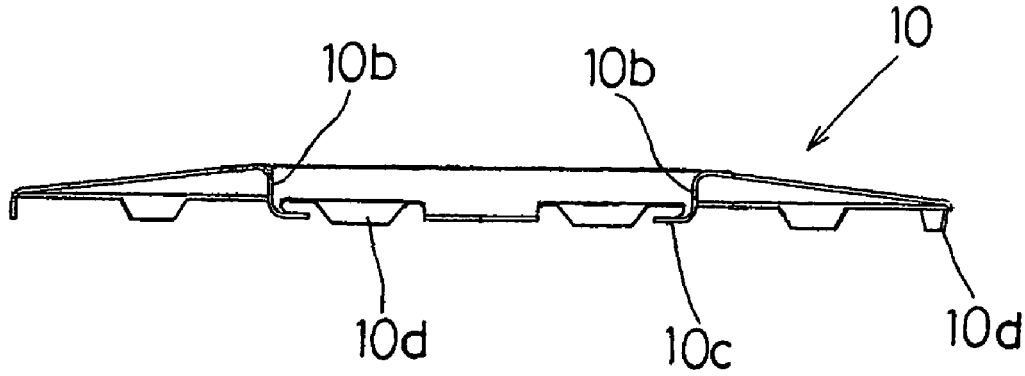
FIG. 6 is a cross sectional view taken along the line VI-VI in FIG. 5.

The details of the dust screen member 10 are shown in FIGS. 5 and 6. As shown in FIG. 5, this dust screen member 10 may be prepared from a thin metallic plate by perforating or punching technique to represent a generally annular dish-shape having a center hole 10*a* and a plurality of perforations 10*e*. As shown in FIG. 6, this dust screen member 10 has an inner peripheral wall 10*b* extending axially downwardly from an inner peripheral edge thereof in the center hole 10*a*. The inner peripheral wall 10*b*, when the dust screen member 10 is mounted in position on the unitary fan-pulley assembly F as will be described later, is positioned along radial outer surfaces of the engagement projections 91. Positioning tabs 10*c* equal in number to the engagement grooves 92 (FIG. 2) are integrally formed with a lower circumferential edge of the inner peripheral wall 10*b* so as to extend radially inwardly therefrom. The dust screen member 10 is supported on the starter pulley 9 by a bracket 11 as will be described later.

An outer peripheral edge of the dust screen member 10 is formed integrally with a plurality of bent pieces 10*d* extending axially downwardly therefrom, which bent pieces 10*d* are utilized to cut lawn grasses or the like. The perforations 10*e* are defined in an area between the outer and inner peripheral edges of the dust screen member 10. When this dust screen member 10 is mounted on the unitary fan-pulley assembly F to cover the cooling fan 8, the dust screen member 10 serves to prevent dust such as lawn grasses from entering the cooling fan 8 and also to cut into fine pieces relatively lengthy lawn grasses tending to enter the cooling fan 8.

Figure 7A:
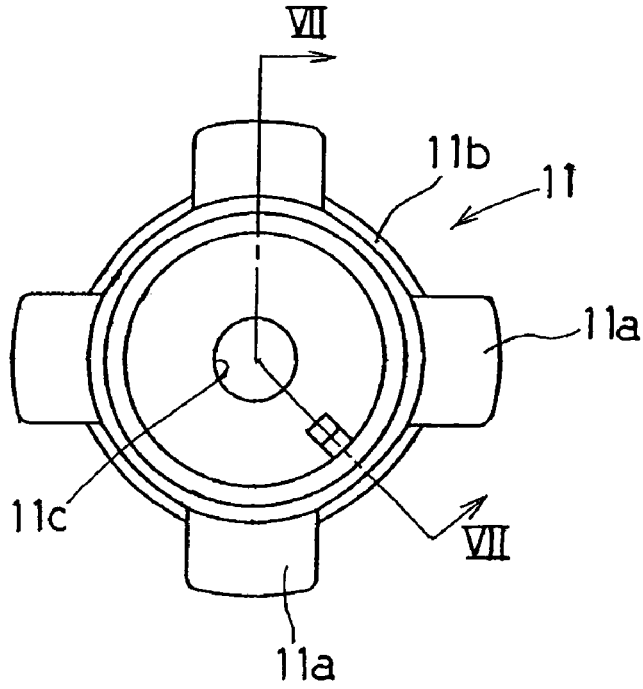
FIG. 7A is a top plan view of a bracket employed in the combustion engine.
Figure 7B:
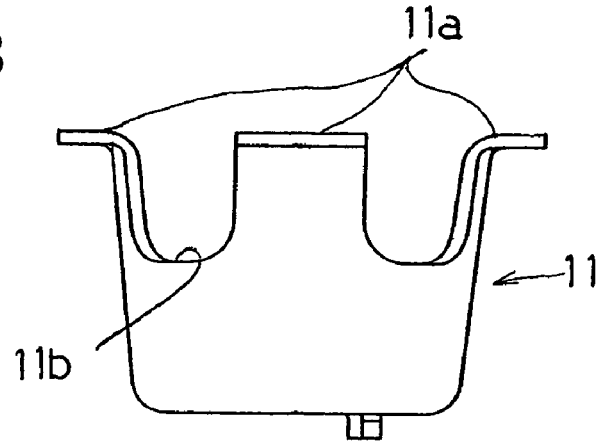
FIG. 7B is a side view of the bracket shown in FIG. 7A.
Figure 7C:
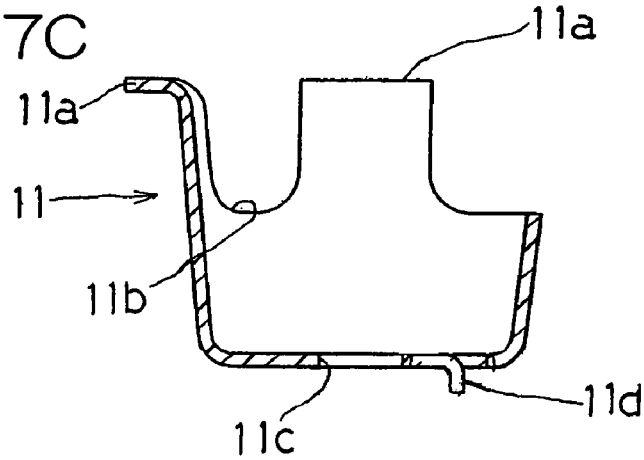
FIG. 7C is a cross-sectional view taken along the line VII-VII in FIG. 7A.

The bracket 11 used to support the unitary fan-pulley assembly F is shown in FIGS. 7A to 7C. The bracket 11 is prepared by shaping a metallic plate into a generally cup-like shape through a press work. As shown in FIG. 7B, the cup-like shape bracket 11 has an upper opening in an axially outward direction thereof and is formed integrally with a plurality of petaloid tongues 11*a* that protrude radially outwardly from an upper open end thereof and are spaced an equal distance from each other in a direction circumferentially thereof. Formed between the neighboring tongues 11*a* are dale portions 11*b*. As shown in FIG. 7A, four petaloid tongues 11*a* are employed and spaced 90° from each other in a direction circumferentially of that open end of the bracket 11 while the corresponding number of the dale portions 11*b* are employed between the neighboring tongues 11*a*. As shown in FIG. 7C, this bracket 11 has a bottom wall formed with a mounting hole 11*c*, defined in the center of the bottom wall, and also with a detent 11*d* offset from the mounting hole 11*c*. This detent 11*d* is utilized to engage the flywheel 7 to prevent a rotation of the bracket 11 relative to the flywheel 7.

As will be described in detail subsequently, the bracket 11 is mounted on the crankshaft 1 together with the unitary fan-pulley assembly F, as shown in FIG. 1.

Figure 8:
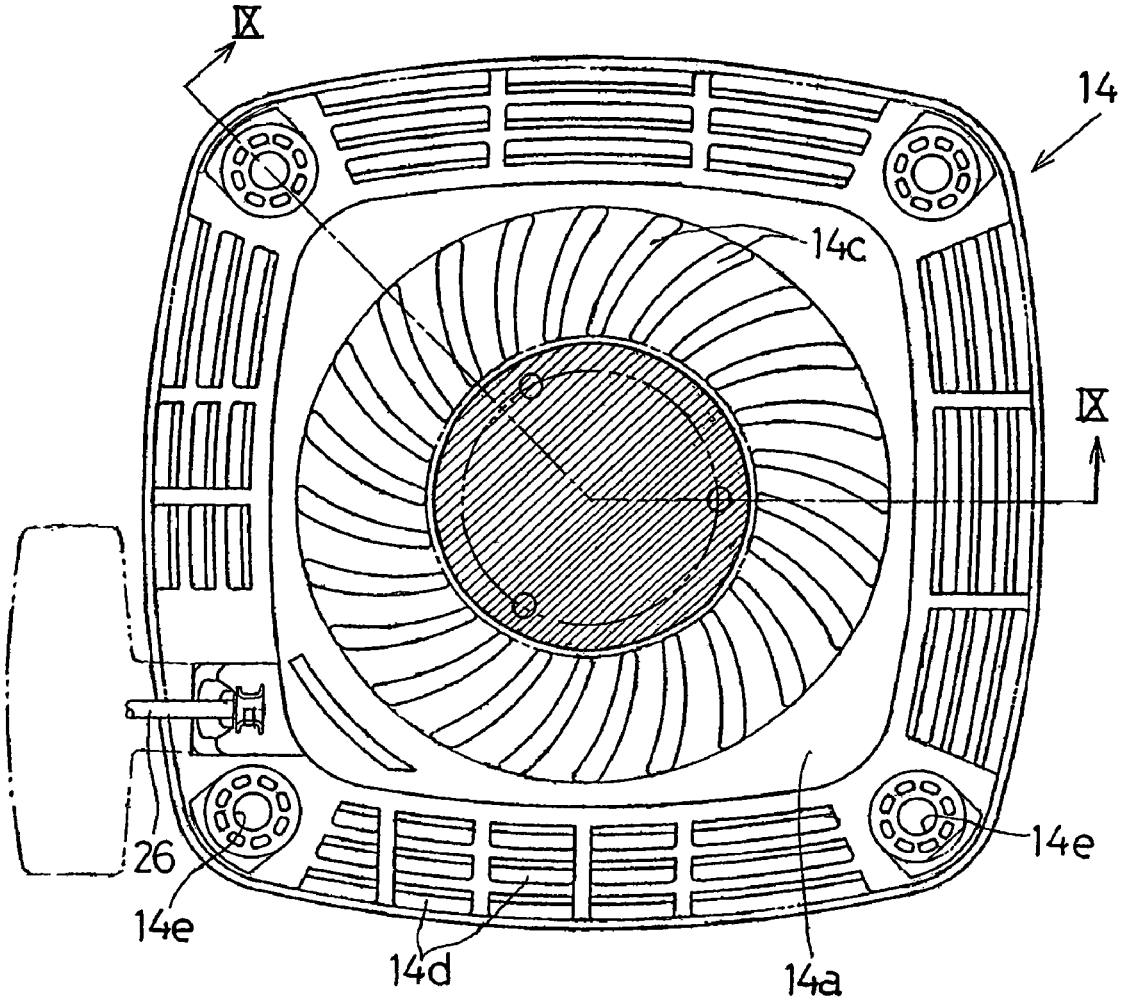
FIG. 8 is a top plan view showing a recoil starter employed in the combustion engine.

As shown in FIG. 1, a recoil starter 14 is mounted atop the engine cover 6, which is utilized as a mounting base for the recoil starter 14. As shown in FIG. 8, the recoil starter 14 includes a starter casing 14*a*, which represents a substantially rectangular shape when viewed from top. When engagement pawls 14*b*, provided inside the starter casing 14*a* and movable in a direction radially outward of the recoil starter 14 so as to project, are engaged with the engagement projections 91 (FIG. 2) of the pulley 9 in a radial direction of the pulley 9, a starting force generated through manual operation of the recoil starter 14 can be received by the pulley 9.

The starter casing 14*a* is made of a synthetic resin and is, as shown in FIG. 8, formed with a plurality of air intake slots 14*c* and 14*d* defined in top and four side walls of the starter casing 14*a*, respectively. Four corner areas of this starter casing 14*a* have respective mounting holes 14*e* adapted to receive therein corresponding bolts 15 to secure the starter casing 14*a* to the engine cover 6.

Figure 9:
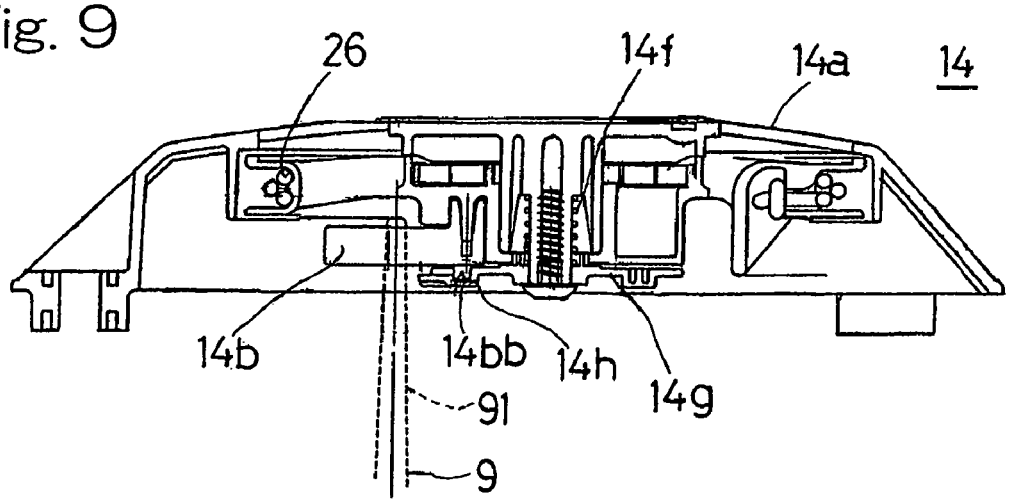
FIG. 9 is a cross-sectional view taken along the line IX-IX in FIG. 8.

More precisely, as shown in FIG. 9, this recoil starter 14 is of a design, in which the engagement pawls 14*b* are provided inside the starter casing 14*a* so as to extend in a direction perpendicular to the longitudinal axis of the recoil starter 14 and are pressed downwards by the action of a common spring 14*f*, provided along the longitudinal axis of the recoil starter 14, to allow respective projections 14*bb* of the engagement pawls 14*b* to engage in corresponding guide grooves 14*h*. When a rope 26 is pulled, the engagement pawls 14*b* are, while being guided by the respective guide grooves 14*h*, rotated to protrude radially outwardly to engage with the engagement projections 91 of the pulley 9, so that the pulley 9 can receive a rotating force or a starting force.

Mounting of the unitary fan-pulley assembly F is carried out in the following manners. In the first place, the flywheel 7 is mounted on the upper end 1*b* of the crankshaft 1 shown in FIG. 1, followed by mounting of the unitary fan-pulley assembly F onto a top surface (an axially outer surface) of the flywheel 7. The screen member 10 is then mounted on the unitary fan-pulley assembly F. At this time, the positioning tabs 10*c* of the dust screen member 10 shown in FIG. 5 have to be nested in the corresponding engagement grooves 92 each defined between the neighboring engagement projections 91 integral with the pulley shown in FIG. 2.

Subsequently, the bracket 11 is inserted from above into the starter pulley 9 with the tongues 11*a* (shown in FIGS. 7A to 7C) of the bracket 11 nested into the corresponding engagement grooves 92 (FIG. 2) until the bottom wall of the bracket 11 is placed on the upper end 1*b* of the crankshaft 1 shown in FIG. 1. Then, a fastening member 12 such as a set bolt is inserted into the mounting hole 11*c* at the bottom of the bracket 11 through a washer 13 and is then, while the assembly F is kept in contact with the top surface (the axial outer surface) of the flywheel 7, threaded into a screw hole in the upper end 1*b* of the crankshaft 1 to fix the flywheel 7, the unitary fan-pulley assembly F and the screen member 10 to the crankshaft 1. Thus, only one fastening member 12 is sufficient to fix the flywheel 7, the unitary fan-pulley assembly F and the screen member 10 with the crankshaft 1.

Figure 10:
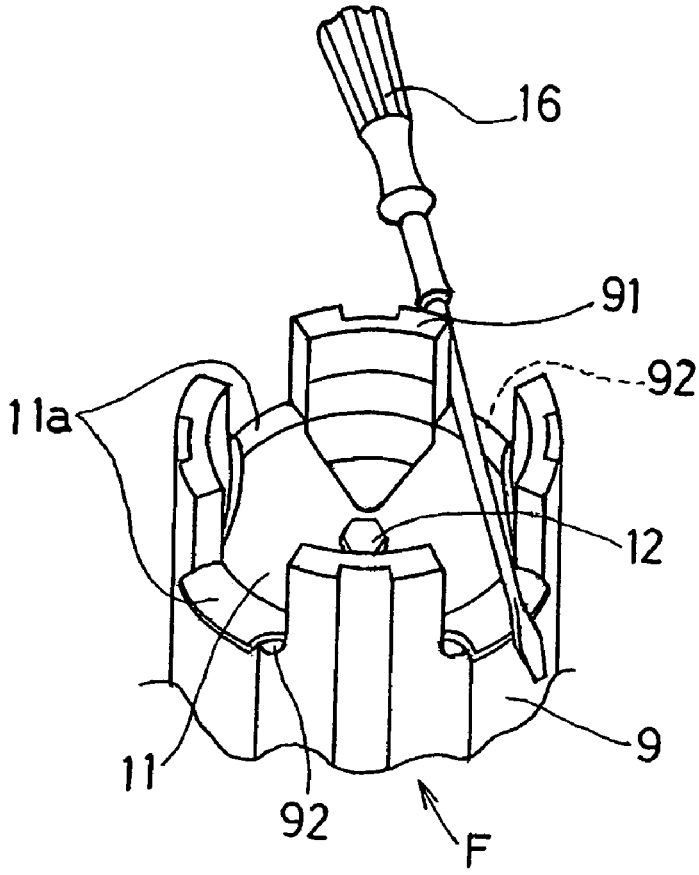
FIG. 10 is a perspective view, on an enlarged scale, showing the manner in which a fastening member for connecting a cooling fan is removed.
Figure 11:
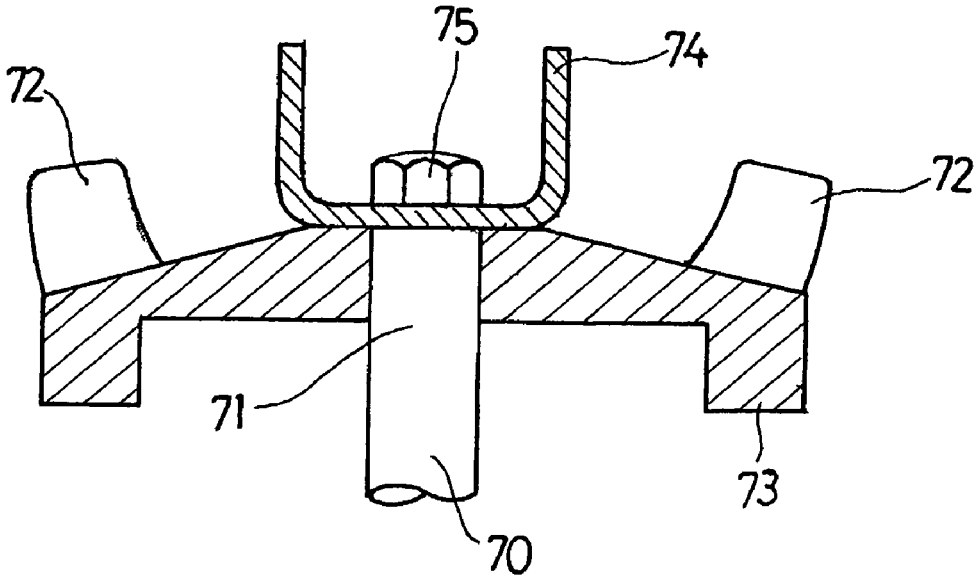
Fig. 11 PRIOR ART
FIG. 11 is a longitudinal sectional view showing the structure in which a cooling fan and a starter pulley are mounted in the conventional internal combustion engine.

When removing the unitary fan-pulley assembly F, the set bolt 15 is first removed to allow the recoil starter 14 to be removed from the engine cover 6 so that the unitary fan-pulley assembly F can be exposed to the outside. Subsequently, the set bolt 12 is loosened to allow the bracket 11 to be removed and, in this condition, cleaning of the unitary fan-pulley assembly F and servicing of the pulley 9 can be carried out. At that time, as shown in FIG. 10, a fit drive tool 16 such as a screw driver is inserted so as to straddle between the neighboring engagement grooves 92 in the pulley 9 so that the fit drive tool 16 can be brought into contact with the neighboring engagement projections 91 to keep the pulley 9 from being rotated. In this condition, using a tool such as a wrench, the set bolt 12 is undone to remove it from the crankshaft 1.

Since the engagement projections 91 are made of the synthetic resin, the neighboring projections 91 when engaged with the fit drive tool 16 will be tortured by the fit drive tool 16 and will then be deformed in a radially outward direction to fall down. However, since the engagement projections 91 are supported by the inner peripheral wall 10*b* of the screen member 10 shown in FIG. 6, the radial outward deformation of the engagement projections 91 can be prevented.

After the removal of the set bolt 12, the bracket 11, the screen member 10 and the unitary fan-pulley assembly F, all shown in FIG. 1, are successively removed to the outside. After the cleaning of the unitary fan-pulley assembly F, those components 10,11 and F are assembled in a manner substantially reverse to that described hereinabove. During the servicing, the unitary fan-pulley assembly F can be handled as a single integer and, therefore, it is quite easy to remove and mount it.

With the combustion engine E so constructed as hereinbefore described, since the unitary fan-pulley assembly F, in which the cooling fan 8 and the starter pulley 9 are formed integrally with each other, is a member separate from the flywheel 7, it can be formed of the synthetic resin by resin molding. Accordingly, the fan blades 81 of the cooling fan 8 shown in FIG. 2 can be formed to have a thin-walled feature to thereby increase the performance of the cooling fan 8. Also, in addition to an advantage in reducing the number of component parts, the unitary fan-pulley assembly F has an advantage in that it can be handled as a single integer and, therefore, mounting thereof onto the crankshaft 1 (FIG. 1) and mounting and removal thereof during the servicing can be accomplished easily.

Also, the flywheel 7 employed in the practice of the present invention may have its weight increased enough to increase an inertia force. In addition, since the engagement grooves 92 between the neighboring engagement projections 91 of the pulley 9 are axially pressed by the corresponding petaloid tongue 11*a* integral with the bracket 11, deformation of the engagement projections 91, which would otherwise occur under the influence of impacts generated upon engagement of the engagement pawls 14*b* with the respective engagement projections 91, can advantageously be suppressed.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing the combustion engine E to which the present invention is applied reference has been made to the vertical shaft type internal combustion engine, the present invention can be equally applied to any combustion engine of a horizontal shaft type.

Accordingly, such changes and modifications are, unless they depart from the scope of the present invention as delivered from the claims annexed hereto, to be construed as included therein.

What is claimed is:

1. A combustion engine having a unitary fan-pulley assembly, which engine comprises:

a crankshaft;

a cooling fan fixedly mounted on the crankshaft; and a starter pulley for receiving a starting force through engagement with engagement pawls of a recoil starter;

wherein the cooling fan and the starter pulley are formed together as a single structure by integrally molding the cooling fan and the starter pulley by resin molding to define a unitary fan-pulley assembly, wherein the integrally formed cooling fan and starter pulley are made of a synthetic resin.

2. The combustion engine as claimed in claim 1, wherein the starter pulley is of a drum-like shape having a plurality of engagement projections spacedly arranged in a direction circumferentially thereof and protruding in a direction axially thereof, the engagement projections being engageable with the engagement pawls of the recoil starter.

3. The combustion engine as claimed in claim 2, further comprising a dust screen member disposed axially outwardly of the unitary fan-pulley assembly and having an inner peripheral wall so defined in an inner periphery thereof as to extend axially and proximately along respective outer surfaces of the engagement projections, the inner periphery being formed with positioning tabs engagable with respective engagement grooves, each defined between the neighboring engagement projections of the starter pulley, in an axial direction of the unitary fan-pulley assembly.

4. The combustion engine as claimed in claim 2, further comprising a bracket fixedly mounted on the crankshaft together with the unitary fan-pulley assembly and operable to urge engagement grooves, each defined between the neighboring engagement projections of the starter pulley, in an axial direction of the unitary fan-pulley assembly.

5. The combustion engine as claimed in claim 4, wherein the bracket is of a generally cup-like shape opening axially outwardly and having a plurality of tongues that are spacedly arranged in a direction circumferentially thereof and protrudes in a direction radially outwardly thereof, each of the tongues being urged against the engagement grooves of the starter pulley.

6. The combustion engine as claimed in claim 4, wherein the unitary fan-pulley assembly and the bracket are fastened to the crankshaft by a common fastening member.

7. The combustion engine as claimed in claim 4, further comprising a dust screen member disposed axially outwardly of the unitary fan-pulley assembly and wherein the screen member is urged into the engagement grooves of the starter pulley by the bracket to be supported by the starter pulley.

8. The combustion engine as claimed in claim 1, wherein the synthetic resin is selected from the group consisting of a polyamide resin and a glass fiber reinforced resin.

9. The combustion engine as claimed in claim 1, further comprising a flywheel fixedly mounted on the crankshaft and wherein the unitary fan-pulley assembly is held in contact with an axial outer surface of the flywheel.

10. A combustion engine having a unitary fan-pulley assembly, which engine comprises:

a crankshaft;

a cooling fan fixedly mounted on the crankshaft; and a starter pulley for receiving a starting force through engagement with engagement pawls of a recoil starter;

wherein the cooling fan and the starter pulley are formed integrally with each other to define a unitary fan-pulley assembly, wherein the starter pulley is of a drum-like shape having a plurality of engagement projections spacedly arranged in a direction circumferentially thereof and protruding in a direction axially thereof, the engagement projections being engageable with the engagement pawls of the recoil starter, and further comprising a bracket fixedly mounted on the crankshaft together with the unitary fan-pulley assembly and operable to urge engagement grooves, each defined between the neighboring engagement projections of the starter pulley, in an axial direction of the unitary fan-pulley assembly.

11. The combustion engine as claimed in claim 10, wherein the bracket is of a generally cup-like shape opening axially outwardly and having a plurality of tongues that are spacedly arranged in a direction circumferentially thereof and protrudes in a direction radially outwardly thereof, each of the tongues being urged against the engagement grooves of the starter pulley.

12. The combustion engine as claimed in claim 10, wherein the unitary fan-pulley assembly and the bracket are fastened to the crankshaft by a common fastening member.

13. The combustion engine as claimed in claim 10, further comprising a dust screen member disposed axially outwardly of the unitary fan-pulley assembly and wherein the screen member is urged into the engagement grooves of the starter pulley by the bracket to be supported by the starter pulley.

* * * * *